US007011879B1

(12) United States Patent
Contreras et al.

(10) Patent No.: US 7,011,879 B1
(45) **Date of Patent: *Mar. 14, 2006**

(54) COMPOSITE POLYMERIC TWIST TIE

(75) Inventors: Luis C. Contreras, Placentia, CA (US); Jack L. Hoffa, Brea, CA (US); Dilip R. Patel, Tustin, CA (US)

(73) Assignee: Johnston International Corp., Tustin, CA (US)

( * ) Notice: Subject to any disclaimer, the term of this patent is extended or adjusted under 35 U.S.C. 154(b) by 189 days.

This patent is subject to a terminal disclaimer.

(21) Appl. No.: 10/650,562

(22) Filed: Aug. 28, 2003

Related U.S. Application Data

(60) Continuation-in-part of application No. 10/095,765, filed on Mar. 13, 2002, now Pat. No. 6,673,413, which is a division of application No. 09/583,021, filed on May 30, 2000, now Pat. No. 6,372,068, which is a continuation-in-part of application No. 09/400,254, filed on Sep. 21, 1999, now abandoned.

(51) Int. Cl.
*B32B 3/06* (2006.01)

(52) U.S. Cl. ..... 428/99; 428/172; 428/156; 428/192; 428/516; 383/127; 493/193

(58) Field of Classification Search ..... 428/99, 428/172, 167, 516, 480, 156, 192; 385/83, 385/136; 383/127; 493/193
See application file for complete search history.

(56) References Cited

U.S. PATENT DOCUMENTS

| | | | | |
|---|---|---|---|---|
| 3,290,854 | A | 12/1966 | MacMurray | |
| 4,797,313 | A | 1/1989 | Stolk et al. | |
| 5,154,964 | A | 10/1992 | Iwai et al. | |
| 5,238,631 | A | 8/1993 | Stolk et al. | |
| 5,342,687 | A | 8/1994 | Iwai et al. | |
| 5,607,748 | A | 3/1997 | Feltman | |
| 5,827,461 | A * | 10/1998 | Feltman | 264/177.1 |
| 5,989,683 | A | 11/1999 | Haddock et al. | |
| 6,372,068 | B1 | 4/2002 | Kincel et al. | |
| 6,673,413 | B1 * | 1/2004 | Kincel et al. | 428/99 |

FOREIGN PATENT DOCUMENTS

| | | |
|---|---|---|
| GB | 2060469 | 5/1981 |
| GB | 2060469 A * | 5/1981 |

* cited by examiner

*Primary Examiner*—Merrick Dixon
(74) *Attorney, Agent, or Firm*—Gordon K. Anderson

(57) ABSTRACT

A polymeric twist tie 20 is taught that utilizes a thermoplastic monofilament 22 having an oriented characteristic produced by stretching a pre-heated monofilament through a heated, volume reducing die. The monofilament 22 is then coated 30 circumferentially with an extrusion of thermoplastic enclosing the monofilament while simultaneously forming a pair of opposed wings 32 integral with the coating. The wings extend outwardly from the coated monofilament allowing the tie to be twisted upon itself with the monofilament retaining its basic configuration and the wings stretching and bending to conform within a coupled twist. The oriented monofilament is fabricated using high density polyethylene and the covering extruded with low density polyethylene which are dissimilar in density, melt index and basic thermoplastic morphology.

6 Claims, 2 Drawing Sheets

COMPOSITE POLYMERIC TWIST TIE

CROSS REFERENCE TO RELATED APPLICATION

This application is a continuation-in part of application Ser. No. 10/095,765 filed Mar. 13, 2002 now U.S. Pat. No. 6,673,413, which is a divisional application of application Ser. No. 09/583,021, filed May 30, 2000 now U.S. Pat. No. 6,372,068, which is a continuation-in-part of application Ser. No. 09/400,254, filed on Sep. 21, 1999, now abandoned.

TECHNICAL FIELD

The present invention relates to twist ties in general. More specifically to an entirely polymeric tie comprised of at least one thermoplastic monofilament that is coated with a dissimilar thermoplastic which is formed with integral outwardly extending wings.

BACKGROUND ART

Previously, many types of twist ties have been used in endeavoring to provide an effective means for closing or tying articles such as bags, fastening plants to stakes, securing bundled electric cable and other restraining tasks. These ties have included strings, wires, adhesive tape, and ribbon sandwiched onto a metallic wire. The most common type of tie presently in use today is a pair of ribbons having a wire bonded in between with the ribbon fabricated of either plastic, paper or both. Attempts to eliminate the wire have resulted in unitary extrusions having a bulb-shaped central portion even to the extent that a core of rubber, or the like, is simultaneously extruded in the center.

Other characterizations of tie material include foil strips or a number of strands of wire in parallel alignment, further attempts have been made to make the tie completely of thermoplastic material that acts like wire by quenching or adding fillers to the formulation to add stiffness and malleability.

DISCLOSURE OF THE INVENTION

A primary object of the invention is to overcome the problems that are prevalent in today's industry using twist tie having a metallic wire sandwiched between two ribbons. In the food industry where their use is widespread, typically bread bags, and other polyethylene bags for various edible products, the ties are mechanically attached and have die cut sharp ends that may inadvertently puncture the bag itself exposing the product to the atmosphere or even piercing the user's fingers or hands.

It has also become a common practice in the food industry to automatically inspect many packages for the presence of metal, such as sliced foods, as cutting blades may leave traces of metal within or near the product. This automatic procedure makes the use of a wire embedded tie extremely objectionable at best and may even eliminate the possibility of its use entirely.

Also since a conventional tie utilizes metal in its composition the original product package employing this type of tie may not be heated in a microwave oven (as high frequency radiation arcs when metal is present) therefore necessitating additional and unnecessary handling and preparation of the packaged product by the user.

Another disadvantage to the use of metal in the tie material is that where the ends of the wire that have been cut off or the plating has been worn off by repeated twisting this surface may introduce undesired oxidization in the form of rust in the presence of moisture.

A further disadvantage of the conventional configuration of the paper and wire tie is that over continued usage the paper covering the wire often twists off and falls away leaving the wire bare or partially stripped and making it hard to handle and manipulate for further reuse.

There have been numerous attempts to produce a unitary non-metallic cordless thermoplastic twist tie that possesses the advantages of using a metal wire without all of the drawbacks. All of the known metal free ties have not as yet proven to be fully satisfactory as they apparently do not function in semi or automatic tying machines and therefore are not widely accepted in the industry at the present time.

It will be understood that the instant invention utilizes the same oriented thermoplastic monofilament having an oriented characteristic produced by stretching the monofilament through a volume reducing die that was heated to a controlled temperature, as taught in the joint inventor's previous patent discussed above. It was found that the twist tie manufactured in accordance with U.S. Pat. No. 6,372,068 and application Ser. No. 10/095,765 functioned properly however an improvement has been found that not only produces complete uniformity and consistency in the manufacturing process but is much simpler and less costly to fabricate.

A patentably significant change was made in the twist tie which utilizes the successful oriented thermoplastic monofilament in conjunction with an extruded coating, which includes an integral pair of wings. This improvement eliminates the step of bonding the monofilament to a separate substrate using an ultrasonic weld and combines the two separate elements with connecting means into a single step of extruding a coating over the oriented monofilament which simultaneously forms the wings. This improvement now makes the twist tie even more practical.

Preferably the invention utilizes two elements made of dissimilar thermoplastic material, a monofilament made of a substance that has the properties of malleable metal wire, in that it is and stays bent to a useable extent, and twists out of the way without breaking and a coating with pair of wings protruding on each side. The tie also preferably substantially reverts to its normal body shape when it is untwisted. Use of these preferred thermoplastic materials in the manufacture of the twist tie permit the monofilament to be twisted and retain this union with the wings that are included in the coating; allowing the wings to follow the monofilaments orientation easily without cracking or yielding.

Another object of the invention is that the twist tie is fabricated of two separate but analogous elements having different degrees of density and melt index. The monofilament replacing the wire has been formed to achieve its dead fold properties and its ability to be easily twisted together and stay connected, also, its repeatability in this operation. Many plastic materials are rigid enough to be bent and retain an angular displacement, however, the thermoplastic must not be too stiff or brittle or it will not function properly as its ability to repeatedly duplicate twisting is of importance in being useful as a twist tie. Both thermoplastic materials in use with this invention are preferably compatible with each other permitting a homogeneous bonding together using conventional extruding techniques.

Yet another object of the invention is that the equipment necessary for orienting the monofilament, while specially fabricated, may be readily available as well as the preferred extruding apparatus well known in the art thus allowing the finished product to be competitively priced creating an advantage to the public.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment. This preferred embodiment is shown in FIGS. 1 through 11 and is comprised of a composite polymeric twist tie 20 that is preferably formed using an oriented thermoplastic monofilament 22 having an oriented characteristic produced by stretching the preheated monofilament through a heated volume reducing die. Any other suitable method of manufacture can be utilized.

Figure 1:
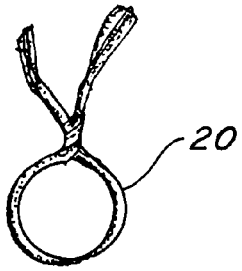
FIG. 1 is a partial isometric view of the preferred embodiment of the twist tie formed into a loop and twisted together shown by itself without any bag closure.
Figure 2:
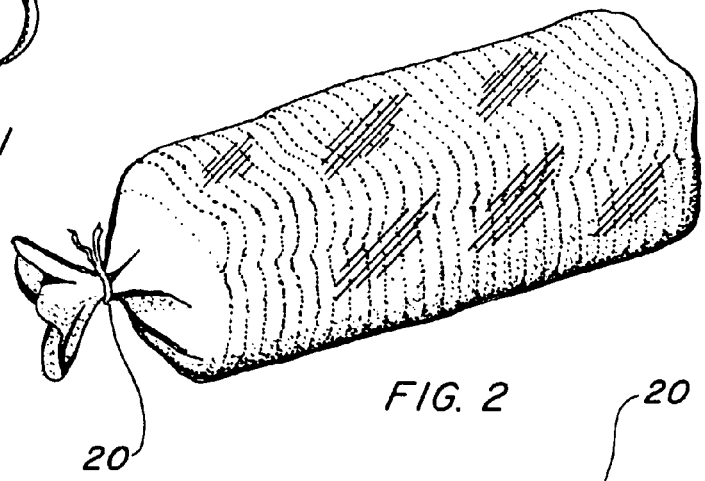
FIG. 2 is a partial isometric view of the preferred embodiment twisted onto the open end of a polyethylene plastic food storage bag.
Figure 3:
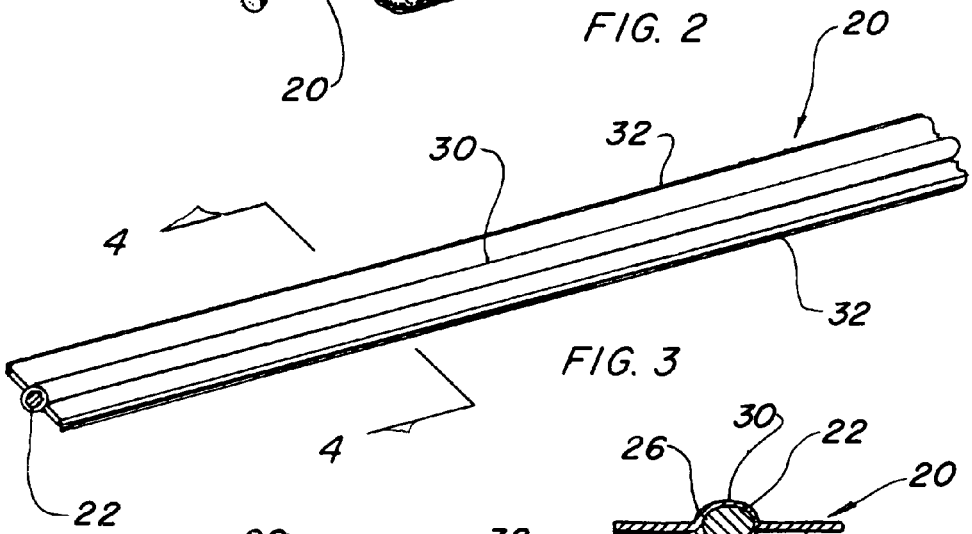
FIG. 3 is a partial isometric view of the preferred embodiment with the tie illustrated in a flat position.
Figure 5:
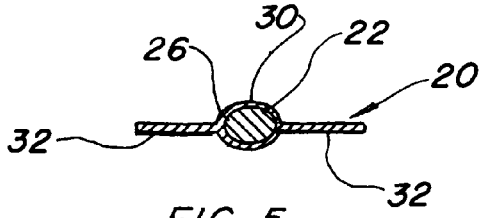
FIG. 5 is a cross sectional view of a configuration of the monofilament in an oval shape.
Figure 4:
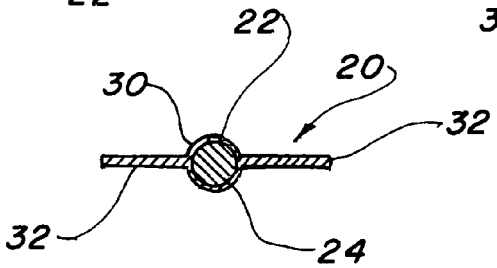
FIG. 4 is a cross sectional view taken along lines 4—4 of FIG. 3 illustrating the preferred single round configuration of the monofilament with the coating covering the monofilament and forming a pair of outstanding wings.
Figure 6:
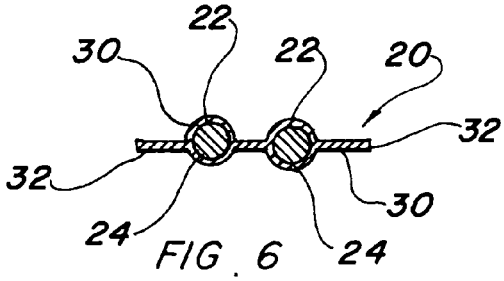
FIG. 6 is a cross sectional view of a configuration illustrating a pair of round monofilaments positioned parallel with the coating connecting the monofilaments together and the wings on the outside edge.
Figure 7:
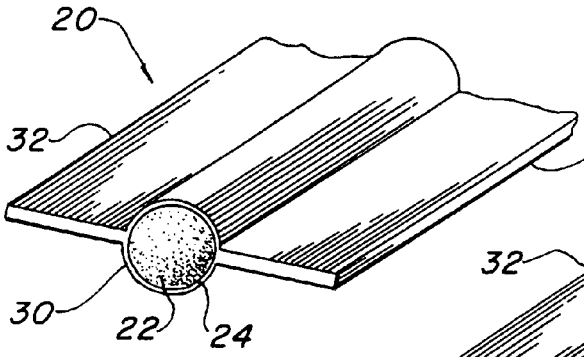
FIG. 7 is an enlarged isometric end view of the twist tie in the preferred embodiment
Figure 8:
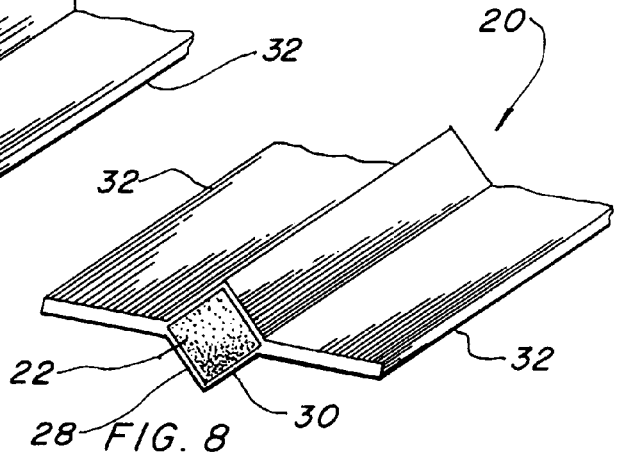
FIG. 8 is an enlarged isometric end view of the twist tie in the square embodiment

The oriented thermoplastic monofilament 22 preferably has a round shape 24 with a diameter of from 0.022 to 0.042 inches (0.056 to 0.107 cm) as shown in FIGS. 4, 6, 7 and 9. While this shape is basically conventional, since the prior art wire core it is replacing is round, it is not limited to this configuration as it may be formed with a substantially oval shape 26, as shown in FIG. 5, a substantially square shape 28 illustrated in FIG. 8 or any other external shape and still be within the parameters of this invention. While one monofilament 22 is preferred two or more may be utilized as shown in FIG. 6.

The function of maintaining the twist and permitting re-twisting numerous times, particularly using only thermoplastic, is a preferred part of the invention. Empirical values on the ability of thermoplastic to maintain a bend may actually permit measuring and comparing the memory of the material to a specific criterion.

Figure 10:
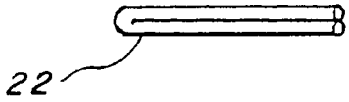
FIG. 10 is a side view of a piece of the monofilament bent until the ends touch relative to testing its dead fold properties.
Figure 11:
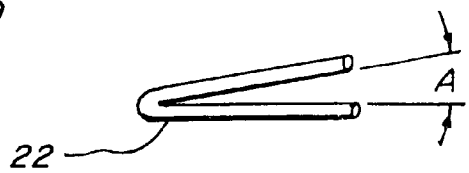
FIG. 11 is a side view of a piece of the monofilament after being bent then relaxed for three minutes, with its angular displacement designated.

At the present time there is no industry standard however, others in the art have utilized a rather simple test which is called a "dead fold test". This test exhibits the specimen materials memory when a sample is folded 180 degrees, approximately in half, with the remaining portions essentially parallel with each other. After relaxing for a period of at least three minutes at the prevailing ambient temperature, the angle of relaxation is obtained by measuring the included angle between the parallel portions. Preferably the invention employs, a monofilament material that has a dead fold angle of no greater than 10 degrees when folded contiguously engaging, in half, and, when relaxed retaining this 10 degree angle for a minimum period of three minutes making it entirely acceptable for this application. FIG. 10 illustrates a small length of the monofilament material 22 in the folded position. FIG. 11 depicts the monofilament 22 in the relaxed position with the alpha symbol "A" indicating the angle.

Testing indicates that high density polyethylene is the preferred material for the monofilament 22, however any orientable thermoplastic material with similar characteristics may be substituted with equal ease and dispatch. Testing has shown that samples of the preferred oriented material, passed the dead fold test in excess of ten times, (which is more than expected in normal twist tie usage), and were capable of being re-tied the same number of times in a typical bag enclosure configuration.

Figure 12:
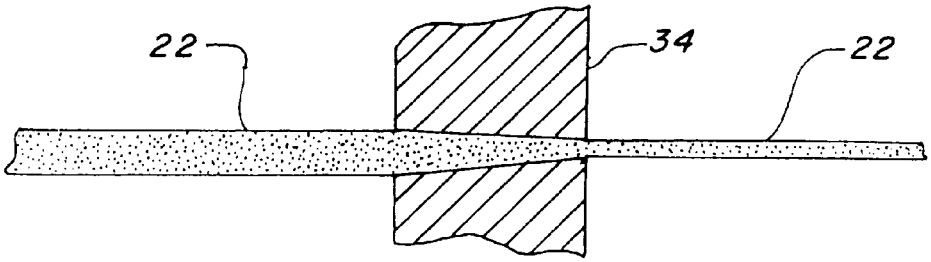
FIG. 12 is an arbitrary cross sectional view of the process apparatus for orienting the monofilament from its original diameter to its final form.

The original process of forming the composite polymeric twist tie is accomplished by first orienting the monofilament 22 to improve its dead fold properties and ability to be easily twisted together and stay connected, also, its repeatability. It has been found that a round rod of pure unmixed high density polyethylene is ideal for the base of this element either in its commercially available formulation or by the addition of from 3.5 to 10% talc, by weight to assist in the drawing and to eliminate adhering together when stored in a roll. In either event this material, is best suited in the form of a substantially round, pure unmixed high density polyethylene rod having a diameter of from 0.110 inch (0.279 cm) to 0.075 inch (0.191 cm). The base material is drawn through a heated tapered die 34 as illustrated in FIG. 12 into a diameter from 0.025 inch (0.064 cm) to 0.035 inch (0.089 cm). The heated tapered die 34 functions best at a temperature below the melting point of the high density polyethylene with at least 265 degrees F. (129.5 degrees C.) being ideal. The polyethylene monofilament 22 in the rod form is preheated to at least 250 degrees F. (121.1 degrees C.) prior to drawing through this heated tapered die 34. The material is drawn through the die 34 with only sufficient pressure to maintain the requisite diameter without a further reduction in size.

Testing has shown that two improvements may be made to the above process which is first that the base material is drawn through the heated tapered die 34 into a diameter of from 0.022 inch (0.042 cm) to 0.056 inch (0.107 cm) and second that the heated tapered die 34 has a temperature of at least 250 degrees F. (121.5 degrees C.) with the balance of the process remaining as originally specified.

The material drawn through the die 34 decreases its original area greater than 5 times using only sufficient tension to maintain the requisite diameter without a further reduction in size after it leaves the die. The prior art of Feltman in U.S. Pat. Nos. 5,607,748 and 5,827,461 uses a so called "draw down" from between 0.5 and 0.9 which is the same ratio as used in the production of the extrusion and is basically standard in the extrusion industry. The prior art of Haddock et al. in U.S. Pat. No. 5,989,683 teaches a "draw down" of 3 to 10 however this is for the entire extruded twist tie.

After the monofilament 22 is oriented, as described above, an extruded thermoplastic coating 30 preferably is added which encloses the monofilament 22 as illustrated in FIGS. 3–9. The coating 30 is formed using a pure unmixed low density polyethylene material. The extrusion coating 30 also preferably includes pair of opposed wings 32 that are integrally formed with the coating 30 and extend outwardly on each side such that the tie may be twisted upon itself with the monofilament 22 retaining its basic configuration and the wings 32 stretching and bending to conform within a coupled twist. FIGS. 5–9 illustrate the integral wings 32 which preferably are extruded along with the coating using conventional extruding equipment such as a thermatic air cooled extruder well known in the art. The preferred die used in the extruding process is the same as a wire coating die except it has opposed slots in each side that form the wings 32. The preferred process uses heat and pressure accomplished in the same manner as wire coating permitting a preferably thin layer around the monofilament 22 and a preferably thicker wing 32 as illustrated best in FIG. 9.

Figure 9:
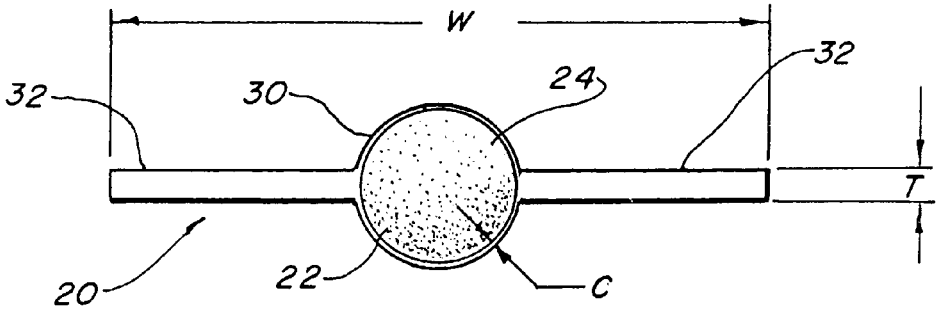
FIG. 9 is a cross sectional view of the preferred embodiment with the overall width, wing thickness and coating width designation.

Through experimentation and to be compatible with existing twist tie apparatus the preferred extruded thermoplastic coating 30 on the monofilament 22 has a thickness of from 0.001 to 0.010 inches (0.0025 to 0.0254 cm.) and the opposed integral thermoplastic wings 32 preferably have a thickness of from 0.002 to 0.009 inches (0.005 to 0.023 cm.). Again to facilitate usage in existing tying equipment the twist tie 20 preferably has an overall width of from 0.125 to 0.250 inches (0.318 to 0.635 cm). FIG. 9 illustrates these dimensional limitations with the coating thickness indicated with the alpha symbol "C", the wing thickness indicated by a "T" and the overall width "W". The invention alternatively can be practiced with a wide range of dimensions other than those just described but may not be readily compatible with existing tying equipment.

Preferably the source polyethylene material of the oriented thermoplastic monofilament 22 and the thermoplastic coating 30 are dissimilar in basic density, melt index and thermoplastic morphology. Polyethylene is a suitable material for practicing the invention, and is formed from a polyolefin resin. This polymer is known for its toughness and utility useable from temperatures ranging from −70 to 200 degrees F. (−57 to 93 degrees C.) and also its superior chemical resistance. The low density grades of polyethylene typically are flexible and tough and the high density materials are more rigid and have high creep resistance. Toughness is the primary property affected by the melt index with the lower melt index having the greatest toughness. Low density polyethylene typically has a specific gravity of from 0.912 to 0.950 and a melt index of 2.0 to 20.0 while the high density material has a specific gravity of 0.941 to 0.980 and a melt index of 1.0 to 5.0. Polyethylene base material has mid-range frictional properties, fair to good dimensional stability and linear thermal expansion up to the melting point.

It will be noted that enclosing the monofilament 22 with a coating 30 may be performed contemporaneously with said basic orienting procedure described above.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A polymeric twist tie comprising:

a thermoplastic monofilament having an oriented characteristic produced by stretching a preheated monofilament through a heated volume reducing die, wherein said oriented thermoplastic monofilament is high density polyethylene material, with said high density polyethylene monofilament having a characteristic achieved by preheating the monofilament to at least 250 degrees F. (121.1 degrees C.) and stretched through a tapered die preheated to at least 250 degrees F. (121.1 degrees C.) decreasing its original area greater than 5 times, an extruded thermoplastic coating enclosing said monofilament, and at least one grippable wing extension integral with the coating extending outwardly therefrom such that the tie may be twisted upon itself with the monofilament retaining its basic configuration and the wing extension stretching and bending to conform within a coupled twist.

2. A polymeric twist tie comprising:

a thermoplastic monofilament having an oriented characteristic produced by stretching a preheated monofilament through a heated volume reducing die, an extruded thermoplastic coating enclosing said monofilament, at least one grippable wing extension integral with the coating extending outwardly therefrom such that the tie may be twisted upon itself with the monofilament retaining its basic configuration and the wing extension stretching and bending to conform within a coupled twist, and wherein said extruded coating and at least one grippable wing extension further comprises a low density polyethylene.

3. The polymeric twist tie as recited in claim 2 wherein said low density polyethylene extruded coating and wing extension comprises a coating on the monofilament and wing extensions produced with said low density polyethylene under heat and pressure.

4. A polymeric twist tie comprising:

a thermoplastic monofilament having an oriented characteristic produced by stretching a preheated monofilament through a heated volume reducing die, an extruded thermoplastic coating enclosing said monofilament, wherein said extruded thermoplastic coating on the monofilament has a thickness of from 0.001 to 0.010 inches (0.0025 to 0.025 cm.), and at least one grippable wing extension integral with the coating extending outwardly therefrom such that the tie may be twisted upon itself with the monofilament retaining its basic configuration and the wing extension stretching and bending to conform within a coupled twist.

5. A polymeric twist tie comprising:

at least one oriented thermoplastic monofilament having dead fold properties, an extruded thermoplastic coating circumferentially enclosing said thermoplastic monofilament, said coating including a pair of opposed wing extensions extending from either side of said monofilament such that the tie may be twisted upon itself with the monofilament retaining its basic configuration and the wing extensions stretching and bending to conform within a coupled twist, and wherein said oriented monofilament is high density polyethylene and said thermoplastic coating is low density polyethylene.

6. A polymeric twist tie comprising:

an extrusion of oriented thermoplastic monofilament encased in a thermoplastic coating, a pair of opposed wing extensions simultaneously formed with the coating, such that the tie may be twisted upon itself with the monofilament retaining its basic configuration and the wing extensions stretching and bending to conform within a coupled twist, and wherein said oriented monofilament is pure natural high density polyethylene and said thermoplastic coating is pure natural low density polyethylene.

* * * * *